United States Patent [19]

Zarzosa-Castilla et al.

[11] 4,213,281

[45] Jul. 22, 1980

[54] CONSTRUCTION OF ROOFS, FLOORS AND BEAMS

[76] Inventors: Agustin F. Zarzosa-Castilla; Ma. Hilda Parcero-de Zarzosa, both of Escobedo Sur 733-201, Monterrey, Nuevo Leon, Mexico

[21] Appl. No.: 859,467

[22] Filed: Dec. 12, 1977

[51] Int. Cl.[2] ..... E04B 5/30

[52] U.S. Cl. ..... 52/323; 52/325; 52/333

[58] Field of Search ..... 52/320, 321, 322, 323, 52/324, 325, 327, 328, 329, 330, 331, 332, 333; 249/28, 30, 31

[56] References Cited

U.S. PATENT DOCUMENTS

| | | | |
|---|---|---|---|
| 1,838,583 | 12/1931 | Slocum | 52/324 |
| 1,926,182 | 9/1933 | Sereff | 52/321 X |
| 1,941,211 | 12/1933 | Inglee | 52/329 X |
| 2,357,408 | 9/1944 | Kupel et al. | 52/321 |

*Primary Examiner*—Price C. Faw, Jr.
*Assistant Examiner*—Carl D. Friedman
*Attorney, Agent, or Firm*—Laurence R. Brown

[57] ABSTRACT

The present invention relates to improvements in the construction of roofs, floors, and more specifically, to a structure permitting the pouring of reinforced concrete without the need of other frames or centering. This becomes possible by using a beam with hollows (structure type) having the capacity for supporting without deflecting the weight of elements which make up the slab thereby enabling the beam to be self-supporting. A counter brace helps support the filler elements and the reinforced concrete.

1 Claim, 4 Drawing Figures

CONSTRUCTION OF ROOFS, FLOORS AND BEAMS

Figure 1:
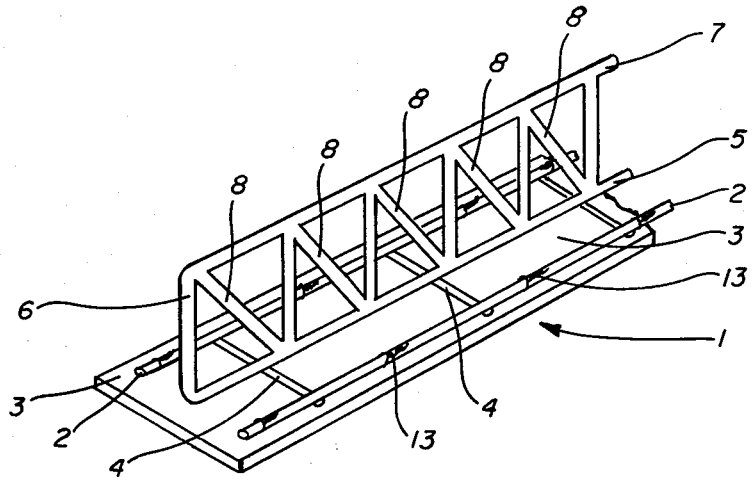
Figure 2:
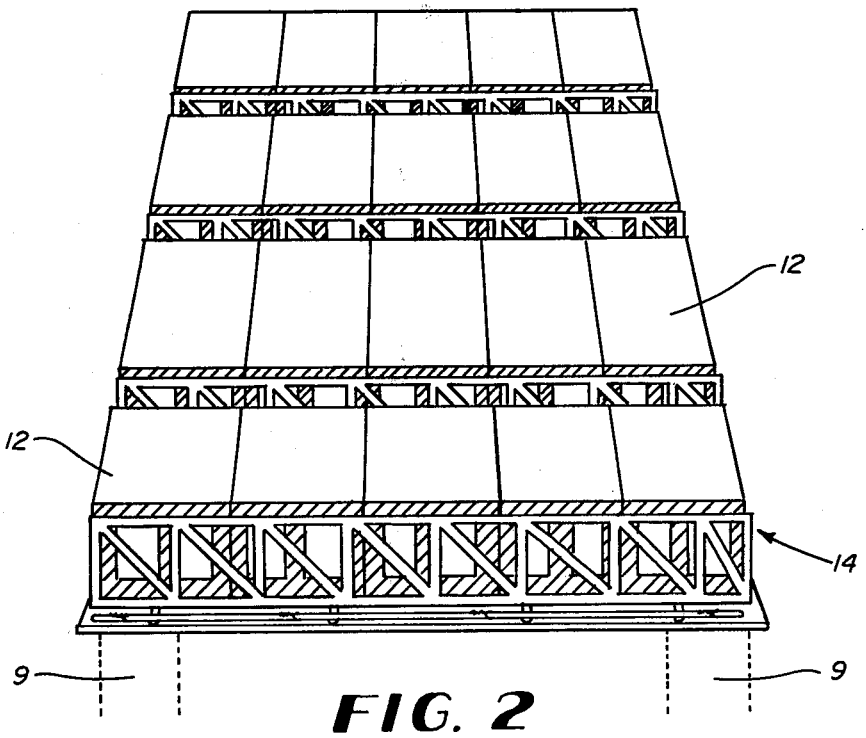
Figure 3:
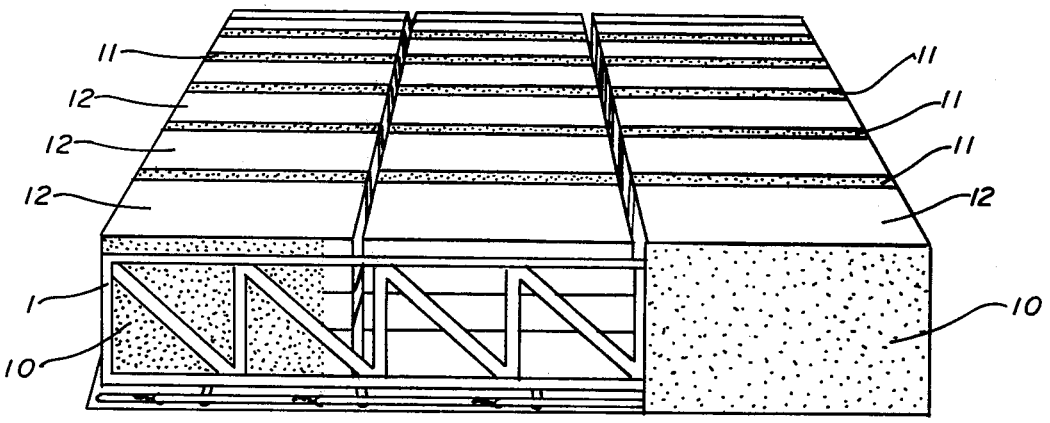
Figure 4:
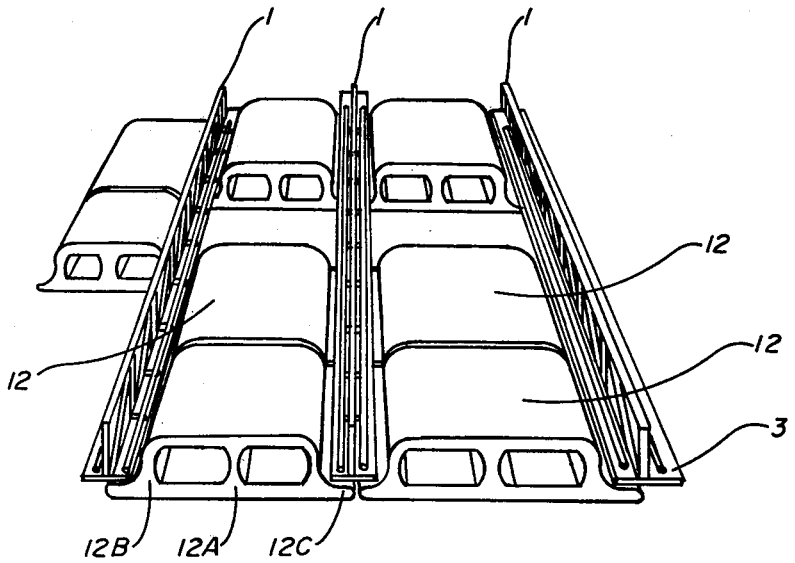

An objective of the present invention is to eliminate the need for setting up a frame or centering and removing it as is presently done in the construction industry. Current industry practice requires the use of wood centering beams or of a metallic frame or centering, which demand greater lay-out of means, extra labor, and longer time for laying and removal of the frame, along with the consequently higher cost.

Another objective of the present invention is to allow the construction industry to have a continuous process since, as a consequence of eliminating the frame or centering, it is possible to finish the activities of construction in the time without having to wait for the frame to be removed.

Likewise, through the use of the present invention it is possible to obtain greater structural strength, stability of the slab due to the steel design, and the possibility of eliminating accelerators in the process of setting the concrete, since there would be no hurry to remove the frame or centering.

Consequently, along with the advantages previously mentioned, other factors are eliminated which result in greater cost, longer time and in some cases lower the strength of the construction.

The characteristic details of the present invention are clearly shown in the following description and in the drawings which accompany it as an illustration of it, using the same reference symbols to point out the same parts in the figures shown.

FIG. #1 shows a perspective view of a section of the beam.

FIG. #2 shows a perspective view of several beams placed parallel to each other, filler elements and the counter brace.

FIG. #3 shows a partial cut away view of a section of the beam, the filler elements, the lever and the reinforced concrete which has been poured to form the slab.

FIG. #4 shows a cross-sectional view of the filler elements, the beam and reinforced concrete which has been poured to form the slab.

With reference to said figures, the improvements are characterized by the combination of a beam (1) which is prefabricated of iron rods, which can be transported to the construction site once assembled. The beam (1) is characterized by the combination of a base which is made up of bolster beams (2) which are laid out parallel to each other and are joined by crossbars (4) which at the same time join the bolster beams (2) together, and due to their thickness allow the bolster beams (2) to remain reasonably separated from the counter brace (3) for the purpose of allowing, in the resulting space between the bolster beam (2) and the counter brace (3), reinforced concrete (10) to filter through, completely covering the base of the beam (1), to the desired degree.

Joining the crossbars (4) by suitable means but preferably by soldering, is a central lower rib (5) on which a plurality of poles (6), rest and which in their upper part support the upper central rib (7). Between the space created by one pole between (6), tie bars (8) are conventionally placed, which give support to the structure so that the beam (1) may work adequately.

By means of conventional ties (13) the counter brace (3) and the beam (1) are joined in such a manner that said beam (1) rests on the counter brace (3) and at the same time is held fast to the beam (1). Once this maneuver is accomplished, the beam (1) is placed resting its ends (14) on the support points (9) which can be outside walls, enclosures or simple columns. Once the placing of the end (14) of the beam (1) over the support (9) has been accomplished, the filler elements (12) which may be of any kind, are arranged, and once said elements (12) remain in place, one can proceed in the conventional manner to pour the reinforced concrete (10) until the passages (11) are filled, the beams (1) are enclosed, and the filler elements (12) are covered to the degree desired.

Once the pouring has been accomplished and the reinforced concrete which was poured is not yet completely set but has reached a degree of agglutination which prevents its detachment, the braces (3) may be removed freeing them from the ties (13) and in this case the same braces (3) may be saved for subsequent pourings.

It is possible for the same filler material (12) to work as a counter brace and in such circumstances said filler material (12) is arranged as shown in FIG. #4, in which the lower lid (12 a) of the filler material (12) is carried out to an extension (12 b) whose border (12 c) is joined to the opposite border in such a way as to allow the pouring to be carried out without the need of the counter braces (3) described above.

It is important to make clear that in the terms of the description it is possible to use the present procedure with conventional filler material (12) or with filler material specifically designed for pouring.

Undoubtedly, the combination of the means may vary in shape and arrangement, consequently it is not our intention to limit the scope of our invention to the figures and description herein stated, but to claim for ourselves any procedure which following the principles described produce the same industrial results.

What we claim is:

1. A self-supporting reinforced structure for reinforcing concrete roofs and floor forming a beam with hollows comprising, in combination, a pair of bolster beams disposed in spaced relationship, a plurality of crossbars extending between the bolster beams securedly joining the bolster beams together, rib means disposed on the top of the crossbars and secured thereto for providing structural strength to the beam, and counter brace means for supporting the beam and providing structural strength to the beam so that said beam is self-supporting after an agglutinatable filler material has been poured over the beam prior to the time said filler material becomes partially agglutinated, and a pair of hollow filler block elements disposed in spaced relationship, each of said filler elements having a respective extension, said extensions of two adjacent filler elements comprising substantially flat surfaces extending toward and disposed proximally adjacent each other to form a hollow for receiving said counter brace and beams thereon and for receiving thereover filler material poured into the hollow, said counter brace means being engagingly supported before filling said hollow solely by the flat surfaces of said extensions, thereby providing said additional strength enabling the pouring of the filler material to be accomplished without using other counter braces.

* * * * *